US006244349B1

(12) United States Patent
Brisco

(10) Patent No.: US 6,244,349 B1
(45) **Date of Patent: *Jun. 12, 2001**

(54) CIRCULATING NIPPLE AND METHOD FOR SETTING WELL CASING

(75) Inventor: David P. Brisco, Duncan, OK (US)

(73) Assignee: Halliburton Energy Services, Inc., Duncan, OK (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/079,321

(22) Filed: May 14, 1998

(51) Int. Cl.[7] ..... E21B 19/16

(52) U.S. Cl. ..... 166/379; 166/77.1; 166/77.51; 166/242.1; 166/380

(58) Field of Search ..... 166/379, 380, 166/381, 77.51, 77.1, 242.1

(56) References Cited

U.S. PATENT DOCUMENTS

| | | | | |
|---|---|---|---|---|
| 2,764,428 | | 9/1956 | Murphy | 285/165 |
| 3,133,722 | | 5/1964 | McGuire et al. | 251/309 |
| 3,318,382 | | 5/1967 | Holden et al. | 166/46 |
| 3,656,561 | | 4/1972 | Leven et al. | 173/163 |
| 3,974,875 | * | 8/1976 | Herd et al. | 166/367 |
| 4,047,566 | * | 9/1977 | Duke | 166/285 |
| 4,167,128 | * | 9/1979 | Chandler et al. | 81/66 R |
| 4,245,709 | * | 1/1981 | Manuel | 175/325 |
| 4,474,243 | * | 10/1984 | Gaines | 166/362 |
| 4,613,161 | * | 9/1986 | Brisco | 285/18 |
| 4,659,115 | * | 4/1987 | Cameron | 285/12 |
| 4,688,632 | | 8/1987 | Cooley, Jr. | 166/77.5 |
| 5,191,939 | * | 3/1993 | Stokley | 166/379 |
| 5,348,351 | | 9/1994 | LaFleur et al. | 285/110 |
| 5,501,280 | | 3/1996 | Brisco | 166/373 |

FOREIGN PATENT DOCUMENTS 0215522 3/1987 (EP) .

OTHER PUBLICATIONS

Page entitled "Weco® Original Wing Unions" (undated but admitted to be prior art).
Halliburton Surface Manifold Equipment Catalog (1985), pp. 9–1 and 9–9.

* cited by examiner

*Primary Examiner*—Hoang Dang
(74) *Attorney, Agent, or Firm*—Craig W. Roddy; C. Clark Dougherty, Jr.

(57) ABSTRACT

A circulating nipple used to circulate fluid through well casing while running the casing into a well. The circulating nipple has a body portion and an elongated neck portion. The elongated neck portion is adapted for engagement with a pipe wrench for making the nipple up on the casing string. The body defines one or more holes therethrough adapted for receiving a handle or operating bar therein. The operating bar may be used as an alternative to, or in addition to, the use of the pipe wrench for making the nipple up on the casing string. Methods of running casing using the circulating nipple are also disclosed.

62 Claims, 3 Drawing Sheets

CIRCULATING NIPPLE AND METHOD FOR SETTING WELL CASING

BACKGROUND OF THE INVENTION

1. Field of the Invention

This invention relates to circulating nipples used for filling well casing and for circulating fluid through well casing while setting or running the casing in a well, and more particularly, to a circulating nipple having an extended neck portion adapted for receiving a pipe wrench thereon and having holes therein adapted for receiving a handle or operating bar therethrough to facilitate installation and removal of the nipple.

2. Description of the Prior Art

It is conventional practice to drill a well to a desired depth and set casing in the well by running a casing string and then cementing the casing in place. The casing string is made up by connecting a plurality of casing sections or joints as the string is lowered into the well. The casing string is held stationary while each section of the casing is connected to the top of the existing casing string. The casing string is then lowered until the top of the string approaches the level of the rig floor. The next section of casing is assembled on the casing string, and the casing is again lowered. As each length of casing or casing section is connected, a circulating nipple, sometimes referred to as a circulating swage, is made up on the upper end of the casing string. The nipple is designed with a casing or tubing pin thread at the bottom and a smaller connection at the top for engagement with fluid flow lines. This top connection is typically a two-inch FIG. 1502 female connection.

Since the sections of the pipe forming the casing are relatively long, the top of the casing may be as high as thirty to forty feet above the rig floor which requires that the nipple be made up on the upper section of casing that far above the rig floor. This necessitates that the nipple be made up on the casing by hand and tightened with the use of hand-held chain tongs. Prior art circulating nipples are relatively long and heavy, and the outer surface of the nipple is usually a smooth, machined finish. This finish makes it difficult for the chain tongs to "bite" into the surface. As a result, the chain tongs frequently slip which can cause loss of balance of the person trying to make up the nipple as well as increasing the time required to complete the task. In addition, the weight and length of the nipple adds to the problem of maneuvering it into position on the casing.

Therefore, there is a need for a circulating nipple which is easier to handle and position on the casing string and which is also more easily made up on the casing string. The present invention addresses this need in several ways. Because the nipple is designed so that it does not need to be made up with chain tongs, the length and weight of the nipple are approximately thirty to thirty-five percent less than prior art nipples. The lighter weight and shorter length combine to make the nipple easier to handle, especially when making up the casing string a large distance above the rig floor. A neck portion of the nipple has been lengthened compared to the prior art, allowing the use of a pipe wrench thereon if desired to make the nipple up in the casing. Further, holes have been provided on the circulating nipple which allow the use of a handle or operating bar to tighten the nipple. The operating bar is the same as, or similar to, the type used to open and close plug valves, such as Halliburton Lo-Torc® plug valves. Because the bar is inserted into a hole, there is extremely little chance that the bar will slip, thereby minimizing the dangers that are present with the use of chain tongs on prior art nipples. Thus, the circulating nipple of the present invention may be made up more quickly and in a manner which is relatively safer for the person making up the nipple and other personnel on the rig floor.

SUMMARY OF THE INVENTION

The present invention includes a circulating nipple for use in running well casing into a well while pumping fluid into the casing string. The invention also includes methods of running casing into a well using the new circulating nipple.

The invention may be described as a casing nipple comprising a body portion having a casing thread thereon adapted for engagement with a casing connector and also comprising a neck portion extending from the body portion and having a union connection thereon. The body portion preferably defines a transversely extending hole therethrough adapted for engagement by a handle or operating bar. The neck portion preferably has a sufficient length such that a pipe wrench may be grippingly engaged with an outer surface of the neck portion. By using either or both the operating bar and/or pipe wrench, the circulating nipple may be easily threadingly engaged with the casing connector and made up on the casing string.

In one embodiment, the body portion further defines a slot thereon to facilitate drilling the hole. The slot has a radiused surface having a radius slightly larger than a radius of the hole. In one embodiment, the slot is one of a plurality of spaced slots on opposite ends of the hole. A central axis of the hole forms a chord with respect to an outside diameter of the body portion.

A plurality of such holes may be spaced substantially evenly around the body portion. The hole central axes of each of the holes are substantially coplanar, and the plane in which the hole central axes lie is substantially perpendicular to a nipple central axis of the nipple.

Preferably, the body and neck portions are integrally formed. This may be accomplished by machining the nipple from a single piece of bar stock or by permanently attaching a plurality of elements to form the nipple, such as by welding.

Stated in another way, the invention includes an apparatus for use in a well comprising a length of well casing, a casing connector on the length of casing, a circulating nipple defining a central opening therethrough, and a fluid line. The circulating nipple comprises a body connected to an end of the connector and a neck extending from the body. The fluid line is connected to the neck. The fluid line may be further connectable to a fluid source such that fluid may be pumped when and as desired into the casing through the nipple as the casing is being run into the well. The neck may have a wrenching surface thereon of sufficient length for engagement by a pipe wrench, and the body portion may define a hole therethrough adapted for engagement by a handle or operating bar.

The present invention also includes a method of running casing into a well comprising the steps of providing a casing section or length of casing with a casing connector at an upper end thereof, positioning the casing adjacent to and aligned with an upper opening of the well, engaging a body of a casing nipple with an upper end of the casing connector, lowering the casing section into the well, disengaging the nipple from the casing connector, engaging an additional casing section with the casing connector, and engaging the body of the nipple with a casing connector at an upper end of the additional casing coupling. The method may also comprise the step of engaging a fluid line with the neck of the nipple. The step of lowering the casing may comprise pumping fluid through the fluid line and nipple into the casing section. The operator can pump liquid to fill the new section or sections of pipe and/or circulate fluid therethrough. The operator may do this after each section or after a plurality of sections is connected.

The step of providing the casing with a casing connector may comprise connecting a casing coupling to an upper end of the casing section or length of casing or may comprise simply providing an integral casing section with the casing connector forming an integral portion thereof, such as a female thread.

The step of engaging the body of the casing nipple may comprise using a pipe wrench on an elongated neck of the nipple and/or using a handle or operating bar extending through a hole defined in the nipple.

The steps may be repeated as desired to run additional casing sections or lengths of casing into the well.

Numerous objects and advantages of the invention will become apparent as the following detailed description of the preferred embodiments is read in conjunction with the drawings which illustrate such embodiments.

DETAILED DESCRIPTION OF THE PREFERRED EMBODIMENTS

Figure 1:
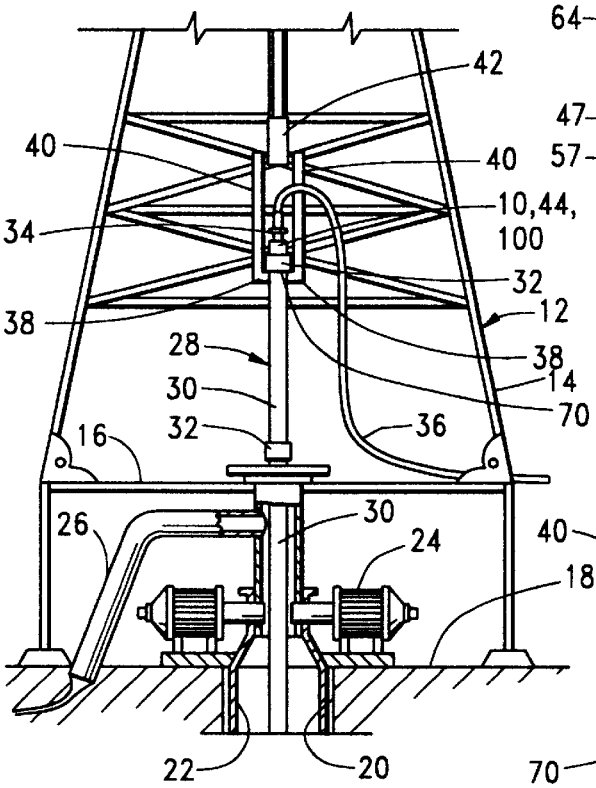
FIG. 1 illustrates a partial schematic of a drilling rig utilizing the circulating nipple for setting or running well casing of the present invention.

Referring now to the drawings, and more particularly to FIG. 1, a first embodiment of the circulating nipple for setting well casing of the present invention is shown in use and generally designated by the numeral 10. A second embodiment generally designated by the numeral 100 will be further described herein. The following description of FIG. 1 also applies to second embodiment circulating nipple 100.

FIG. 1 also illustrates a conventional drilling rig 12 having a derrick 14 and a rig floor 16. Below rig floor 16 is a wellhead 18 with a wellbore 20 therethrough. A length of surface casing 22 is shown set in wellbore 20. A blowout preventer 24 is provided at the top of surface casing 22, and a discharge line 26, which is connected with surface casing 22, conducts drilling fluid to a pond or ditch (not shown) adjacent to drilling rig 12.

Surface casing 22 extends downwardly only a portion of the depth of wellbore 20, and a production casing string 28 is lowered through surface casing 22 and into open wellbore 20 below the surface casing in a manner hereinafter described. There may also be one or more strings of intermediate casing (not shown) below surface casing 22. Surface casing 22 and any intermediate casing are progressively smaller in diameter with the depth of the wellbore.

While the running of casing string 28 into wellbore 20 is described herein, the same procedure may also be employed for running surface casing 22 and intermediate casing into the wellbore. The only difference is the size of circulating nipple 10 or 100 depending upon the size of the particular casing string that is being run.

Casing string 28 is made up of a plurality of casing sections 30. Casing sections 30 are lengths of pipe which are generally about twenty to forty feet long. Adjacent casing sections 30 may be secured together by a casing coupling or collar 32 which is threaded onto the ends of the casing sections. Alternatively, adjacent casing sections 30 may be integral casing sections (not shown) with a male connector of one casing section engaged with a female connector or an adjacent section.

First embodiment circulating nipple 10 or second embodiment nipple 100 is attached to the uppermost casing section 30 by a casing coupling 32 as will be further described herein. Connected to the upper end of circulating nipple 10 is a wing union 34, as will also be further described. Wing union 34 is attached to a hose 36 connected to a mud pump (not shown) of a kind known in the art.

Casing string 28 is lowered into wellbore 20 by means of elevators 38 connected to bails 40 which are in turn connected to a traveling block 42 in a conventional manner.

Figure 2:
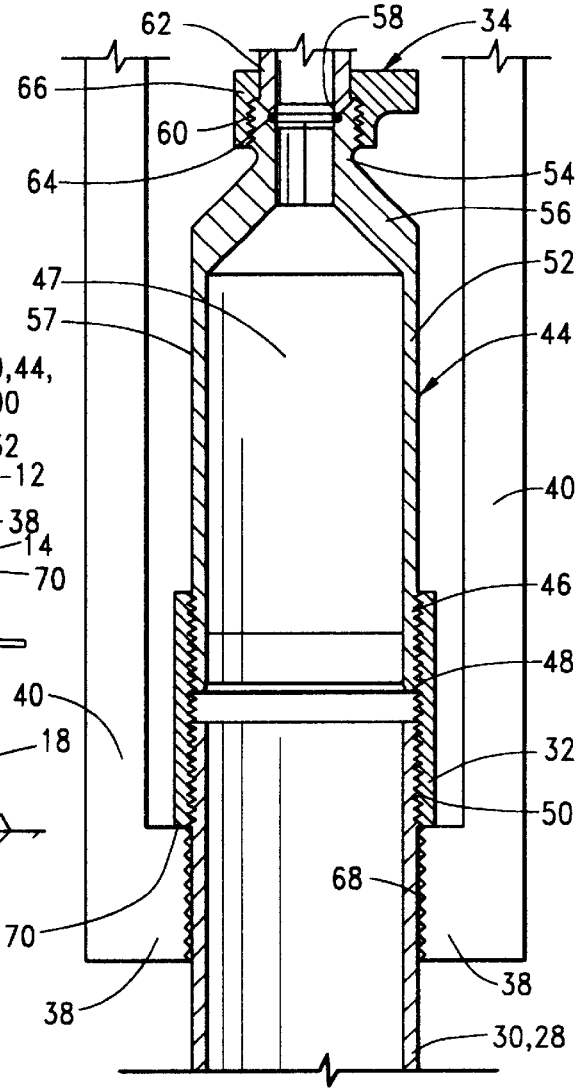
FIG. 2 PRIOR ART
FIG. 2 shows a cross section prior art circulating nipple made up onto a casing string with a fluid line connected thereto as used in setting casing.

Referring now to FIG. 2, a prior art circulating nipple is shown and generally designated by the numeral 44. Prior art nipple 44 has a threaded lower end 46 attached to a casing coupling 32 at threaded connection 48. Prior art nipple 44 defines a central opening 47 therethrough. Casing coupling 32 may be attached to a casing section 30 of casing string 28 at a threaded connection 50 or may form an integral enlarged end of the casing section. FIG. 1 also applies to prior art circulating nipple 44 with regard to the connection of the prior art nipple with the other components associated with drilling rig 12 and casing string 28.

Prior art nipple 44 has an elongated body portion 52 which forms lower end 46 and a relatively short neck portion 54. Body portion 52 has a generally conical transition area 56 connected to neck portion 54.

Body portion 52 must be sufficiently long that chain tongs (not shown) can be engaged with a substantially cylindrical outer surface 57 thereof. The chain tongs are not engaged with neck portion 54 or transition area 56 of body portion 52. Outer surface 57 of body portion 52 is usually a smooth, machined finish, and this makes it difficult for the chain tongs to "bite" into the surface. The result is that the chain tongs frequently slip as previously described.

Neck portion 54 defines a typical female connection 58 therein, such as a two-inch FIG. 1502 female connection, and also has an external thread 60 thereon. Female connection 58 and external thread 60 are adapted for engagement by wing union 34. Wing union 34 includes a male sub 62 which fits into female connection 58. A seal 64 provides sealing engagement between male sub 62 and neck portion 54 of prior art nipple 44. A wing nut 66 of wing union 34 is engaged with external thread 60 to hold male sub 62 in place.

The casing coupling 32 which connects prior art nipple 44 with uppermost casing section 30 of casing string 28 has a downwardly facing shoulder 70 thereon which may be supported on elevators 38 so that casing string 28 with nipple 44 thereon may be lowered into wellbore 20. Alternatively, elevators 38 may be slip-type elevators having a plurality of teeth 68 thereon which may be used to grippingly engage the outside diameter of the corresponding casing section 30. The important aspect is that in any embodiment, casing section 30 is supported below casing coupling 32. It should also be noted that elevators 38 may be used in the same manner on an integral casing section or joint (not shown) of a kind known in the art which has a shoulder formed by an enlarged end with a female thread therein. Basically, an integral casing section is substantially similar to casing section 30 with casing coupling 32 thereon except that it is integrally formed rather than made using two pieces. Any description herein of connecting to casing coupling 32 should be understood to be equivalent to connecting to the female end of an integral casing section. In fact, casing sections 30 are usually supplied at the well site with a casing coupling 32 already attached to one end of the casing section.

Fluid may be circulated through hose 36, wing union 34 and central opening 47 of prior art nipple 44 while lowering casing string 28.

Referring now to FIGS. 3–7, a first embodiment of circulating nipple 10 is shown. Looking first at FIG. 4, nipple 10 defines a central opening 71 therethrough and has a body portion 72 with an outer surface 73 and a threaded lower end 74. Body portion 72 is relatively shorter than body portion 52 of prior art circulating nipple 44. Circulating nipple 10 is not designed to be used with chain tongs and rarely would there be an attempt to make up nipple 10 on casing string 28 by use of such chain tongs. Therefore, the length of outer surface 73 of body portion 72 is relatively shorter to reduce the overall length of circulating nipple 10 as compared to prior art circulating nipple 44. Of course, this results in a decrease in weight as well, making nipple 10 easier to handle than prior art nipple 44. In the preferred embodiment, this decrease in size between circulating nipple 10 of the present invention and nipple 44 of the prior art is approximately a thirty to thirty-five percent reduction. It is only necessary to have body portion 72 of circulating nipple 10 long enough above threaded lower end 74 to allow for a few thread recuts as the threads wear.

Circulating nipple 10 has an elongated neck portion 76 extending from body portion 72. Neck portion 76 is relatively longer than neck portion 54 of prior art circulating nipple 44 because new neck portion 76 is preferably sufficiently long that a pipe wrench 77 may be engaged with outer wrenching surface 78 thereof to tighten circulating nipple 10 into casing coupling 32 on casing section 30 or into a female end of an integral casing connection. Pipe wrench 77 is much easier to use than chain tongs.

Neck portion 76 defines a female connection 80 therein, such as a known two-inch FIG. 1502 female connection, and has an external thread 82 thereon. Female connection 80 and external thread 82 are substantially identical to female connection 58 and external thread 60 on neck portion 54 of prior art circulating nipple 44.

The upper end of body portion 72 has a relatively thicker transition area 84.

Figure 3:
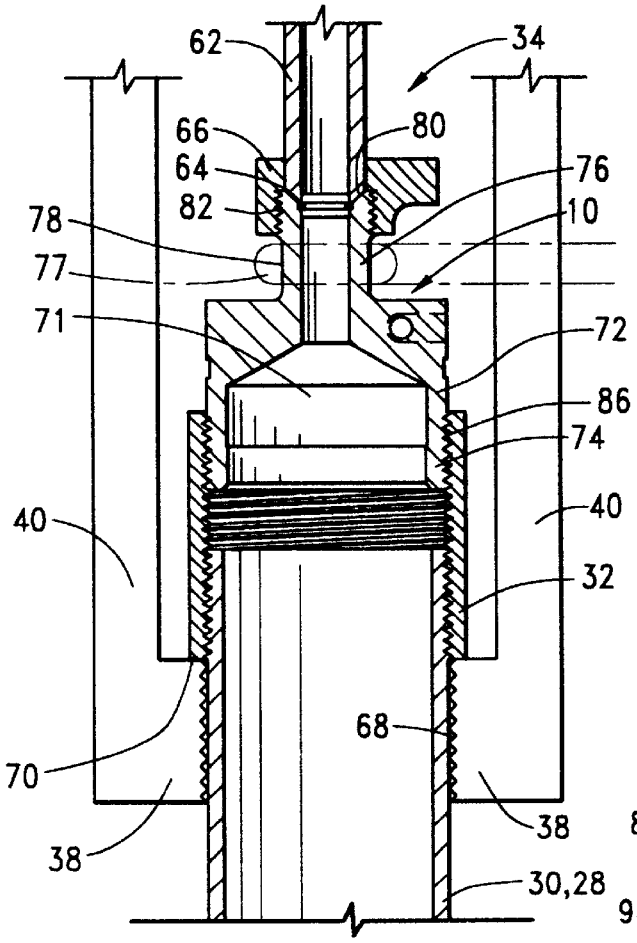
FIG. 3 shows a cross section of a first embodiment of the circulating nipple of the present invention as made up on a casing string with a fluid line connected thereto.
Figure 4:
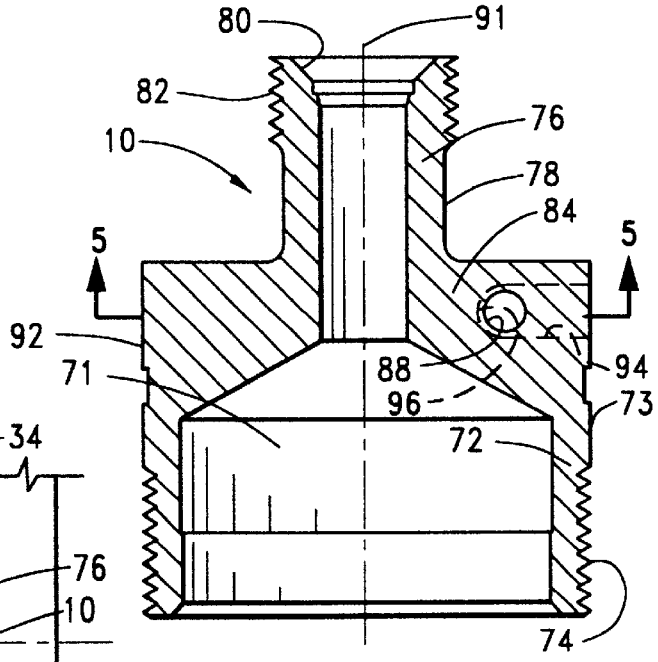
FIG. 4 is a vertical cross section of a first embodiment of the circulating nipple.

Referring now to FIG. 3, circulating nipple 10 is shown made up to an upper casing section 30 of casing string 28 in a manner similar to that shown in FIG. 2 for prior art circulating nipple 44. That is, lower end 74 of body portion 72 of nipple 10 is attached to casing coupling 32 at threaded connection 86. An integral casing section (not shown) may be used rather than a casing section with a separate casing coupling 32. Either forms a casing connector for engagement by circulating nipple 10 or by an adjacent casing section.

A male sub 62 of wing union 34 is disposed in female connection 80, and a seal 64 provides sealing engagement between male sub 62 and female connection 80. Male sub 62 is held in place by a wing nut 66 threadingly engaged with external thread 82 of neck portion 76.

As with prior art circulating nipple 44, shoulder 70 on casing coupling 32 or a similar shoulder on an integral casing section is engaged by elevators 38 extending from bails 40 by which casing string 28 with circulating nipple 10 thereon may be lowered. Also in a manner similar to the prior art, elevators 38 alternatively may have teeth 68 thereon for grippingly engaging the outside diameter of the corresponding casing section 30, rather than supporting the casing section by shoulder 70.

Figure 5:
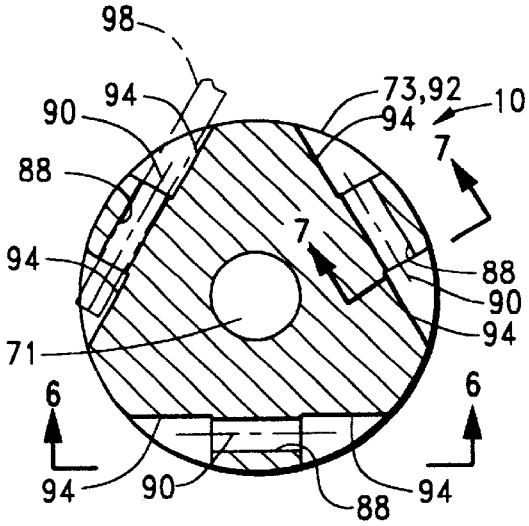
FIG. 5 is a cross-sectional view taken along lines 5—5 in FIG. 4.
Figure 6:
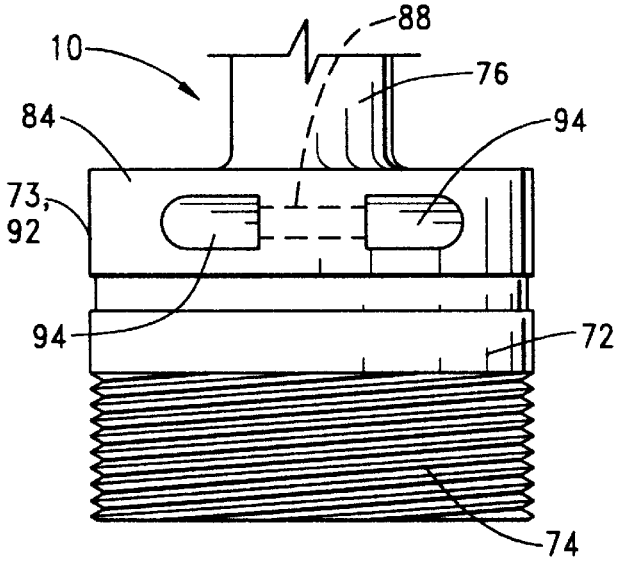
FIG. 6 is a side elevation of the first embodiment of the circulating nipple, such as seen from lines 6—6 in FIG. 5.

Referring again to FIGS. 4–7, additional details of the circulating nipple 10 will be discussed. Referring particularly to FIG. 5, transition area 84 of body portion 72 defines a plurality of holes 88 therein, each of the holes defining a hole central axis 90. Hole central axes 90 are preferably substantially coplanar and each hole central axis forms a chord with respect to outside diameter 92 of outer surface 73. The plane in which central axes 90 lie will be seen to be substantially perpendicular to a nipple central axis 91 of nipple 10.

Central axes 90 of holes 88 are spaced substantially equally radially outwardly from nipple central axis 91, and thus, it will be seen by those skilled in the art that central axes 90 are all tangential to a single imaginary circle. Also, holes 88 are substantially equally spaced circumferentially around circulating nipple 10. However, precise location of holes 88 is not particularly necessary and other arrangements of the holes may work just as well.

Figure 7:
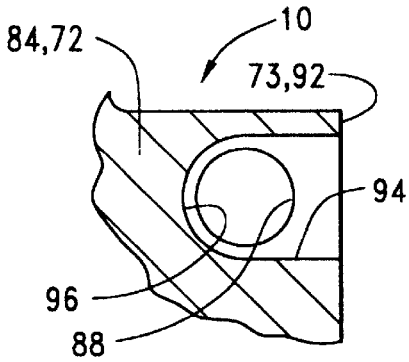
FIG. 7 is a partial cross section taken along lines 7—7 in FIG. 5.

A slot 94 is formed in circulating nipple 10 on opposite ends of each hole 88. That is, there are a pair of spaced slots 94 associated with each hole 88. Slots 94 are provided as a relief in body portion 72 to facilitate drilling of holes 88 therein. As best seen in FIG. 7, but also shown in FIG. 4, each slot 94 has a radiused inner surface 96 which is approximately concentric with hole 88 and has a slightly larger radius so that a slight relief is formed between slots 94 and holes 88.

Holes 88 are adapted for receiving a handle or operating bar 98 therethrough which may be positioned in any of the holes and used as a lever to tighten circulating nipple 10 into casing coupling 32 on casing section 30 or into a female end of an integral casing section. Such an operating bar is a primarily cylindrical rod having a taper on one end to facilitate insertion into the hole and a knurled surface on the other end to facilitate being gripped by the operator. Preferably, but not by way of limitation, the holes are large enough to receive a one-inch diameter operating bar 98, such as used to open and close Halliburton Lo-Torc® plug valves. This use of operating bar 98 in holes 88 may be used as an alternative to, or in addition to, tightening circulating nipple 10 with the previously mentioned pipe wrench 77 engaged on outside wrenching surface 78 of neck portion 76.

Figure 8:
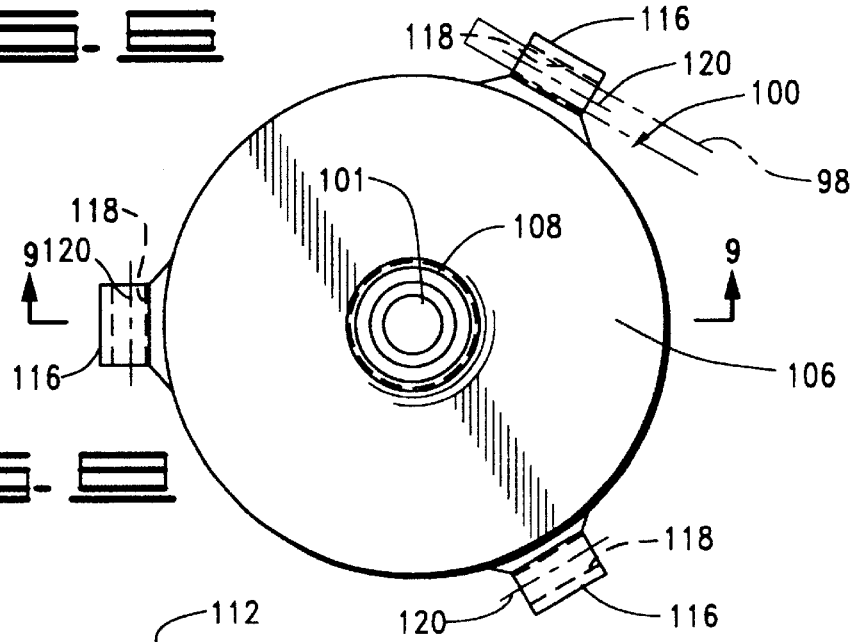
FIG. 8 is a plan view of a second embodiment of the circulating nipple of the present invention.
Figure 9:
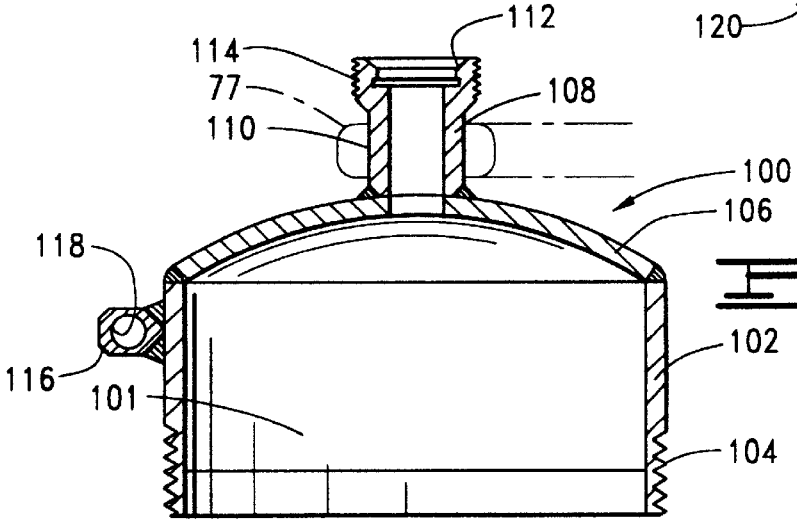
FIG. 9 is a vertical cross section of the second embodiment taken along lines 9—9 in FIG. 8.

Referring now to FIGS. 8 and 9, an alternate embodiment circulating nipple for setting well casing of the present invention is shown and generally designated by the numeral 100. Unlike first embodiment circulating nipple 10 which may be machined from a single piece of bar stock, second embodiment circulating nipple 100 is designed for use with relatively larger casing, for example, surface casing 22. Accordingly, the embodiment shown may be made of several separate pieces which are welded into an integral unit, although nipple 100 could be formed as a single piece such as by casting, forging, etc.

Second embodiment nipple 100 has a central opening 101 therethrough and has a body portion 102 with a threaded lower end 104. Forming an upper end of body portion 102 is a transition area or member 106 which is generally dome shaped. A neck portion 108 extends from transition area 106 of body portion 102 and has a relatively long outer wrenching surface 110 adapted for engagement by pipe wrench 77. Neck portion 108 of second embodiment nipple 100 is similar to neck portion 76 of first embodiment nipple 10 in that it defines a female connection 112 and an external thread 114 which are adapted for engagement to wing union 34 in a manner previously described.

A plurality of bosses or lugs 116 extend from body portion 102 adjacent to transition area 106. Each boss 116 defines a hole 118 therethrough. Each hole 118 has a hole central axis 120. Hole central axes 120 are preferably substantially coplanar. This plane is substantially perpendicular to a nipple central axis of nipple 100. Also, central axes 120 will be seen to be tangential to a single imaginary circle.

Holes 118, like holes 88 in first embodiment circulating nipple 10, are adapted for receiving operating bar 98 therethrough for tightening the circulating nipple 100 to casing string 28.

OPERATION OF THE INVENTION

In using first embodiment circulating nipple 10 or second embodiment circulating nipple 100, the method of running well casing 28 into wellbore 20 is substantially the same. As already mentioned, casing sections 30 are normally provided at the well site with a casing coupling 32 already attached to one end thereof. An integral casing section (not shown) with an enlarged end having a female thread therein may also be used. Again, such an integral casing section looks substantially the same as a casing section 30 with a casing coupling 32 thereon except that the integral casing section is a single piece. As is well known in the art, an assembly formed with a casing section 30 and a casing coupling 32 thereon is interchangeable with an integral casing section.

In some cases, casing section 30 may not have a casing coupling 32 already engaged therewith. In such cases, casing coupling 32 is threadingly engaged with an upper end of a casing section 30 in the process of running casing. Bails 40 and elevators 38 are positioned as shown in FIG. 1 to engage shoulder 70 on casing coupling 32 or to use teeth 68 to engage casing section 30. Circulating nipple 10 or 100 is threadingly engaged with casing coupling 32 by use of pipe wrench 77 engaging outer wrenching surface 78 of neck portion 76 of nipple 10 or outer wrenching surface 110 of neck portion 108 of nipple 100. Alternatively, or in addition to this use of pipe wrench 77, operating bar 98 may be inserted into one of holes 88 in nipple 10 or one of holes 118 in nipple 100 to make up the threaded connection between the nipple and casing coupling 32.

Wing union 34 is then engaged with neck portion 76 of nipple 10 or neck portion 108 of nipple 100, thus placing central opening 71 of nipple 10 or central opening 101 of nipple 100 in communication with the mud pump through hose 36. Traveling block 42 is lowered so that casing section 30 with attached nipple 10 or 100 is lowered into wellbore 20. When nipple 10 or 100 is near rig floor 16, the nipple is disengaged from casing coupling 32, and another length of casing 30 is engaged with that particular casing coupling 32. Nipple 10 or 100 is then connected to another casing coupling 32 at the top of the new casing section 30 in the same manner previously described.

This procedure is repeated for as many casing sections 30 as necessary for the well. While thus running casing string 28 into wellbore 20, the casing string may be filled when desired by the mud pump through hose 36, well union 34 and nipple 10 or 100. Also, the fluid may be further pumped down casing string 28 to circulate the fluid if desired as the casing string is run into wellbore 20 with the circulated fluid returning through the annulus between the casing string and wellbore. This filling or circulating process may be carried out for each casing section 30 or may be done after a plurality of casing sections has been run depending upon the desires of the operator and the well conditions.

With either nipple 10 or 100, the use of chain tongs is not necessary, and the problems associated with the slippage of such chain tongs on prior art nipples, such as nipple 44, are eliminated. The reduced length and weight of either nipple 10 or 100 compared to the prior art nipple 44 makes it easier to make up nipple 10 or 100 on casing string 28. Manipulating a lighter and smaller nipple and eliminating the slipping problem with the chain tongs thus helps reduce or eliminate some dangers associated with the prior art nipples and methods of installing them.

It will be seen, therefore, that the circulating nipple for setting casing in a wellbore and method of use are well adapted to carry out the ends and advantages mentioned. While presently preferred embodiments of the apparatus and steps in the method have been shown and described for the purposes of this disclosure, numerous changes in the arrangement and construction of parts in the apparatus and steps in the method may be made by those skilled in the art. All such changes are encompassed within the scope and spirit of the appended claims.

What is claimed is:

1. A method of setting casing in a well comprising the steps of:

(a) providing a casing section with a casing connector at an upper end thereof;

(b) positioning said casing section adjacent to and aligned with an upper opening of the well;

(c) engaging a body of a casing nipple with said casing connector using an operating bar extending through a hole defined in said nipple;

(d) lowering said casing section into the well;

(e) disengaging said nipple from said casing connector;

(f) engaging an additional casing section with said casing connector; and (g) engaging said body of said nipple with a casing connector at an upper end of said additional casing section.

2. The method of claim 1 further comprising the step of:

(h) repeating steps (d) through (g) as desired.

3. The method of claim 1 further comprising after step (c), the step of engaging a fluid line with said neck of said nipple; and wherein, step (d) includes pumping fluid through said fluid line and nipple into said casing section.

4. The method of claim 1 wherein step (c) further comprises engaging an elongated neck of said nipple with a pipe wrench.

5. The method of claim 1 wherein step (a) comprises connecting a casing coupling to an upper end of said casing section.

6. A method of running casing into a well comprising the steps of:

providing a casing section with a casing connector at an upper end thereof;

engaging a casing nipple with said casing connector using a handle or operating bar engaged with a hole defined in said nipple;

lowering said casing section into the well;

disengaging said casing nipple from said casing connector;

engaging an additional casing section with said casing connector;

engaging said casing nipple with a casing connector at an upper end of said additional casing section; and lowering said additional casing section into the well.

7. The method of claim 6 wherein said casing nipple comprises a body portion having a casing thread thereon adapted for engagement with said casing connector, said body portion having said hole defined therein for engagement by said handle or operating bar.

8. The method of claim 7 wherein said casing nipple comprises a neck portion extending from said body portion.

9. The method of claim 8 wherein said neck portion has a length such that a pipe wrench may be grippingly engaged with an outer surface of said neck portion.

10. The method of claim 8 wherein said body and neck portions are integrally formed.

11. The method of claim 8 wherein said neck portion has a union connection thereon.

12. The method of claim 7 wherein said body portion defines a slot on an end of said hole.

13. The method of claim 12 wherein said slot has a radiused surface having a radius larger than a radius of said hole.

14. The method of claim 7 wherein said body portion defines a pair of slots on opposite ends of said hole.

15. The method of claim 7 wherein a central axis of said hole forms a cord with respect to an outside diameter of said body portion.

16. The method of claim 7 wherein said hole is one of a plurality of holes spaced substantially evenly around said body portion.

17. The method of claim 16 wherein each of said holes defines a hole central axis and said hole central axes are substantially coplanar.

18. The method of claim 17 wherein said casing nipple defines a longitudinally extending nipple central axis and said hole central axes are in a plane substantially perpendicular to said nipple central axis.

19. The method of claim 7 wherein said hole is one of a plurality of holes defined in said body portion, each hole has a central axis and is adapted for engagement by said handle or operating bar, and wherein said central axes of said holes are all tangential to an imaginary circle.

20. The method of claim 6 wherein said casing nipple comprises:

a body portion having a casing thread thereon adapted for engagement with said casing connector, said body portion having a plurality of holes defined therein for engagement by said handle or operating bar;

a neck portion extending from and integrally formed with said body portion wherein said neck portion has a length such that a pipe wrench may be grippingly engaged with an outer surface of said neck portion; and a union connection on said neck portion.

21. The method of claim 20 wherein said holes are spaced substantially evenly around said body portion, each of said holes defines a hole central axis and said hole central axes are substantially coplanar.

22. The method of claim 21 wherein said casing nipple defines a longitudinally extending nipple central axis and said hole central axes are in a plane substantially perpendicular to said nipple central axis.

23. The method of claim 20 wherein each hole has a central axis and is adapted for engagement by said handle or operating bar, and wherein said central axes of said holes are all tangential to an imaginary circle.

24. The method of claim 6 further comprising the steps of:

engaging a fluid line with a neck of said casing nipple; and pumping fluid through said fluid line and casing nipple into said casing section.

25. The method of claim 6 further comprising the step of engaging an elongated neck of said casing nipple with a pipe wrench.

26. A method of running casing into a well comprising the steps of:

providing a casing section with a casing connector at an upper end thereof;

engaging a casing nipple with said casing connector using a handle or operating bar engaged with a hole defined in a boss on said nipple;

lowering said casing section into the well;

disengaging said casing nipple from said casing connector;

engaging an additional casing section with said casing connector;

engaging said casing nipple with a casing connector at an upper end of said additional casing section; and lowering said additional casing section into the well.

27. The method of claim 26 wherein said hole has a central axis tangential to an imaginary circle that is in a plane substantially perpendicular to a central axis of the casing nipple.

28. The method of claim 26 wherein said boss is one of a plurality of bosses spaced around said casing nipple and each boss defines a hole therethrough for engagement by said handle or operating bar.

29. The method of claim 28 wherein each hole has a central axis tangential to said imaginary circle.

30. The method of claim 26 wherein said casing nipple comprises a neck portion extending from said body portion.

31. The method of claim 30 wherein said neck portion has a length such that a pipe wrench may be grippingly engaged with an outer surface of said neck portion.

32. The method of claim 30 wherein said body and neck portions are integrally formed.

33. The method of claim 30 wherein said neck portion has a union connection thereon.

34. The method of claim 26 further comprising the steps of:

engaging a fluid line with a neck of said casing nipple; and pumping fluid through said fluid line and casing nipple into said casing section.

35. The method of claim 26 further comprising the step of engaging an elongated neck of said casing nipple with a pipe wrench.

36. A method of running casing into a well comprising the steps of:

providing a casing section with a casing connector at an upper end thereof;

engaging a casing nipple with said casing connector using a handle or operating bar engaged with a hole defined in a boss on said nipple wherein said boss is one of a plurality of bosses spaced around said casing nipple and each boss defines a hole therethrough for engagement by said handle or operating bar; and lowering said casing section into the well.

37. The method of claim 36 wherein each hole has a central axis tangential to said imaginary circle.

38. The method of claim 36 wherein said casing nipple comprises a neck portion extending from said body portion.

39. The method of claim 38 wherein said neck portion has a length such that a pipe wrench may be grippingly engaged with an outer surface of said neck portion.

40. The method of claim 38 wherein said body and neck portions are integrally formed.

41. The method of claim 38 wherein said neck portion has a union connection thereon.

42. The method of claim 36 further comprising the steps of:

disengaging said casing nipple from said casing connector;

engaging an additional casing section with said casing connector; and engaging said casing nipple with a casing connector at an upper end of said additional casing section; and lowering said additional casing section into the well.

43. The method of claim 36 further comprising the steps of:

engaging a fluid line with a neck of said casing nipple; and pumping fluid through said fluid line and casing nipple into said casing section.

44. The method of claim 36 further comprising the step of engaging an elongated neck of said casing nipple with a pipe wrench.

45. A casing nipple for use in running casing into a well, comprising:

a body portion having a casing thread for engagement with a casing connector; and wherein the casing nipple has a hole adapted for engagement by a handle or operating bar, said hole having a central axis that is tangential to an imaginary circle defined about a nipple central axis, said circle being generally perpendicular to said nipple central axis whereby the central axis of said hole is generally perpendicular to a radius of said circle.

46. The casing nipple of claim 45 further comprising a neck portion extending from said body portion.

47. The casing nipple of claim 46 wherein said body and neck portions are integrally formed.

48. The casing nipple of claim 46 wherein a fluid line is connected to said neck portion, said fluid line being further connectable to a fluid source such that fluid may be pumped into the casing through the casing nipple.

49. The casing nipple of claim 45 wherein said body portion further defines a slot thereon adjacent to said hole.

50. The casing nipple of claim 49 wherein said slot has a radiused inner surface concentric with said hole.

51. The casing nipple of claim 49 wherein said slot is one of a pair of spaced slots on opposite ends of said hole.

52. The casing nipple of claim 45 wherein the central axis of said hole forms a chord with respect to an outside diameter of said body portion.

53. The casing nipple of claim 45 wherein said hole is one of a plurality of holes spaced around said body portion, wherein each hole has a central axis that is tangential to the imaginary circle defined about the nipple central axis.

54. The casing nipple of claim 53 wherein the central axes of said holes are substantially coplanar.

55. The casing nipple of claim 45 wherein said body portion comprises an externally extending boss and said hole extends through said boss.

56. The casing nipple of claim 55 wherein said boss is one of a plurality of bosses spaced around said body portion.

57. A method of running casing into a well comprising the steps of:

providing a casing section with a casing connector;

engaging a casing nipple with said casing connector using a handle or operating bar engaged with a hole in said casing nipple, wherein said hole has a central axis that is tangential to an imaginary circle defined about a nipple central axis, said circle being generally perpendicular to said nipple central axis whereby the central axis of said hole is generally perpendicular to a radius of said circle; and lowering said casing section into the well.

58. The method of claim 57 wherein said casing nipple comprises a neck portion extending from a body portion.

59. The method of claim 58 wherein said neck and body portions are integrally formed.

60. The method of claim 58 wherein said neck portion has a union connection thereon.

61. The method of claim 57 further comprising the steps of:

disengaging said casing nipple from said casing connector;

providing an additional casing section with a casing connector;

engaging said casing nipple with said casing connector of said additional casing section; and lowering said additional casing section into the well.

62. The method of claim 57 further comprising the step of engaging a fluid line with said casing nipple and pumping fluid through said fluid line and casing nipple into said casing section while lowering said casing section into the well.

* * * * *